US006269745B1

(12) United States Patent
Cieplik et al.

(10) Patent No.: US 6,269,745 B1
(45) Date of Patent: Aug. 7, 2001

(54) ELECTRICAL FUSE

(75) Inventors: Ingeborg Cieplik, Witten; Bernd Fröchte, Recklinghausen; Manfred Rupalla, Witten, all of (DE)

(73) Assignee: Wickmann-Werke GmbH (DE)

( * ) Notice: Subject to any disclaimer, the term of this patent is extended or adjusted under 35 U.S.C. 154(b) by 0 days.

(21) Appl. No.: 09/355,791

(22) PCT Filed: Feb. 4, 1998

(86) PCT No.: PCT/EP98/00606

§ 371 Date: Aug. 3, 1999

§ 102(e) Date: Aug. 3, 1999

(87) PCT Pub. No.: WO98/34261

PCT Pub. Date: Aug. 6, 1998

(30) Foreign Application Priority Data

Feb. 4, 1997 (DE) ..... 197 04 097

(51) Int. Cl.[7] ..... F42B 3/13

(52) U.S. Cl. ..... 102/202.5; 337/401; 337/227; 337/297

(58) Field of Search ..... 102/202.5; D13/161; 337/404, 405, 406, 407, 401, 402, 403, 228, 297, 166; 257/529

(56) References Cited

U.S. PATENT DOCUMENTS 4,417,226 * 11/1983 Asdollahi et al. .
4,494,104 * 1/1985 Holmes .
4,626,818 * 12/1986 Hilgers ..... 337/166
4,873,506 * 10/1989 Gurevich .
5,097,247 * 3/1992 Doerrwaechter .
5,166,656 * 11/1992 Badihi et al. ..... 337/297
5,432,378 * 7/1995 Whitney et al. .
5,621,375 * 4/1997 Gurevich .
5,652,562 * 7/1997 Riley .
5,699,032 * 12/1997 Ulm, Jr. et al. .
5,926,084 * 7/1999 Frochte .

FOREIGN PATENT DOCUMENTS 879727 7/1953 (DE) .
2050125 4/1972 (DE) .
30 33 323 A1 3/1981 (DE) .
41 14 495 A1 11/1991 (DE) .
0715328A1 * 10/1995 (EP) .
2163307 2/1986 (GB) .
2284951 * 6/1995 (GB) .

* cited by examiner

*Primary Examiner*—Charles T. Jordan
*Assistant Examiner*—Troy Chambers
(74) *Attorney, Agent, or Firm*—Banner & Witcoff, Ltd.

(57) ABSTRACT

The present invention relates to an electrical fuse element (1) which comprises at least one fusible conductor (3) and a carrier (2). The object is to provide a fuse element (1) for all known tripping characteristics in a cost-effective production technique for the middle and low-current range. Furthermore, by means of a small outer geometry, the fuse element (1) is to be adaptable to modem methods of insertion. The way in which this object is achieved according to the invention is that the carrier (2) consists of a material of poor thermal conduction, in particular of a glass ceramic.

20 Claims, 6 Drawing Sheets

ELECTRICAL FUSE

DESCRIPTION

Figure 1A:
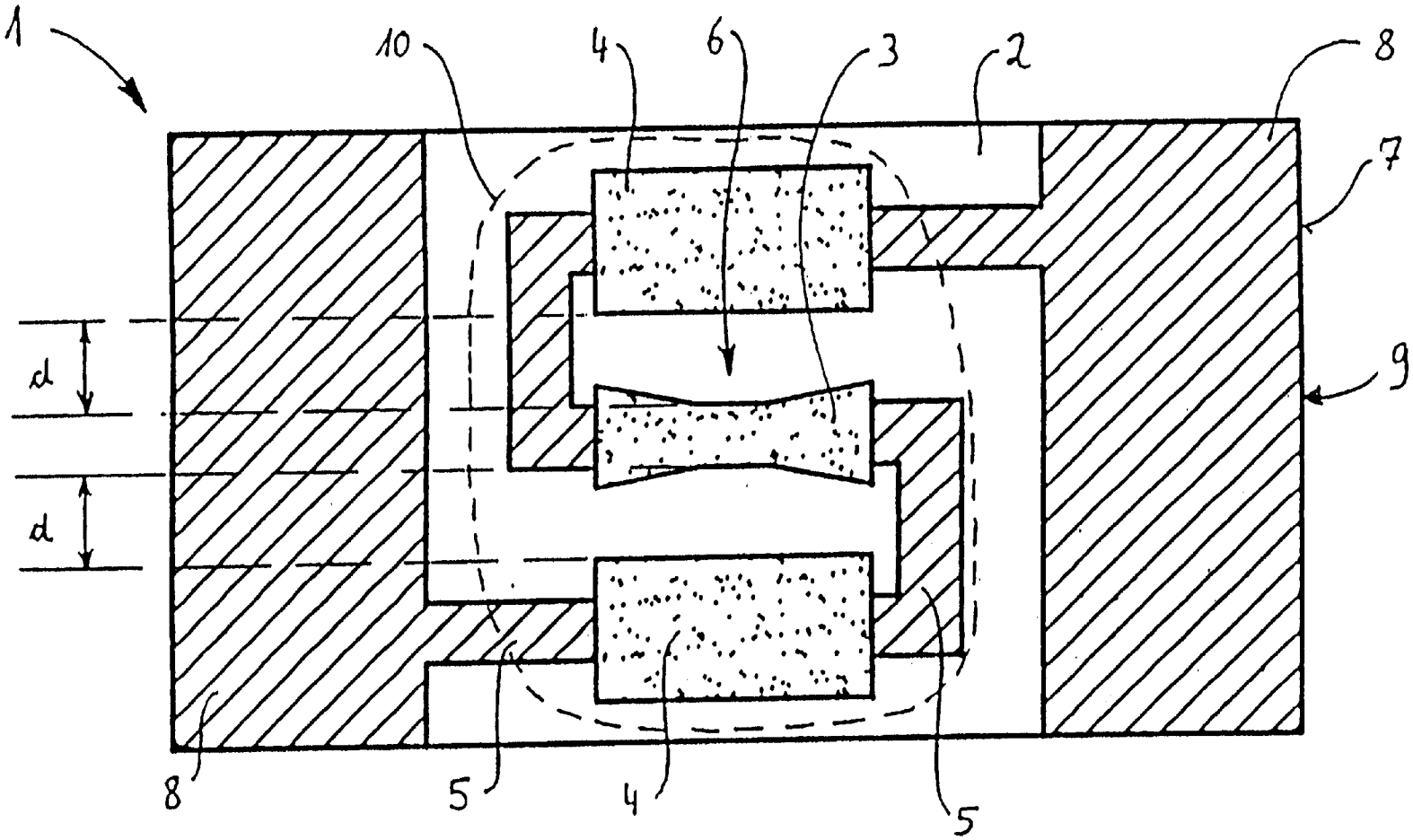

The present invention relates to an electrical fuse element according to the preamble of claim 1.

Fuse elements are used in large numbers for protecting electrical and electronic circuits from excessive currents. In such cases, they have to be adapted to the current ranges occurring in an application, by the tripping characteristics respectively required. The generally perceivable and ever increasing tendency for circuit components to be made smaller while having the same or even enhanced capabilities leads to considerable problems in the area of electrical fuse elements.

EP 0 515 037 A1 discloses a fuse located on the substrate of a hybrid circuit, where the fuse is supported on a thermally insulating layer and teaches to adjust the operating parameters of the fuse by varying e.g. the degree of thermal insulation about the fusible track. With using a support layer having a high thermal resistivity, the effect of raising the total thermal resistivity is not achievable. Thus a fuse cannot be reduced in size. Further very few fusing characteristics can be realized in this way only.

It is therefore the object of the present invention to provide a fuse element for all known tripping characteristics by a cost-effective production technique for the medium and low currant range. Furthermore, by having a smaller outer geometry, the fuse element is to be adaptable to modern methods of insertion.

According to the invention, this object is achieved by that the carrier consists of a material of poor thermal conduction, in particular of a glass ceramic, the fusible conductor is indirectly heated, preferably by at least one additional heating element, where at least one heating element is arranged together with the fusible conductor jointly on the substrate and a distance between the heating element and the fusible conductor is variable, in order to set the degree of thermal coupling with otherwise the same geometry of the circuit.

In the past there have been numerous known attempts to make the outer dimensions of electrical fuse elements considerably smaller while retaining their operational current range, their switching capacity and their specific tripping characteristics. However, these attempts resulted in failure because either the internal heating of the fuse element became too great and/or the desired tripping characteristic could not be achieved, or the fuse element became unsoldered at its contact points owing to increased self-heating.

By the use according to the invention of a carrier made of a material of poor thermal conduction, the present invention overcomes a widespread prejudice to the use of such materials in fuse construction. By the use of such a carrier material, the hot zone (hot spot) of the fuse element can be advantageously restricted to the core region of the carrier or of the housing, since the heat dissipation is very low. Thus, the heat removal by conduction via the external contacts is significantly less. Consequently, unsoldering of its own accord or inadmissible heating is no longer possible for a fuse element according to the invention. Furthermore, by concentrating the "hot spot" in a certain region, the entire power consumption of a fuse element according to the invention is lowered. Thus, a minimal power consumption also results in less of a retroactive effect on the surrounding electric circuit.

Among suitable materials of poor thermal conduction are ceramics, glass ceramics or glass. Glass ceramics are preferred, however.

For a cost-effective mass production of fuse elements according to the invention with their small geometrical sizes, formation of the carrier in sheet form is advantageous, preferably in the form of a sheet-like substrate. Thus, fuse elements according to the invention can be produced in a cost-saving manner in multiple repeats, for example in the size of customary service-mounted devices (SMDs) on a planar substrate.

In a fuse element according to the invention, the fusible conductor may act as a single heat source. However, to set different nominal currents and switching characteristics, an indirect heating of the fusible conductor is preferred.

At least one additional heating element serves for this purpose. In the case of some embodiments, two heating elements are used with preference, for example, as is shown below with reference to illustrations of a number of exemplary embodiments according to the invention. Cases with more than two heating elements are also conceivable. When reference is made below to a heating element, these possibilities are also intended to be included.

A fuse having an addition a heating element is known e.g. form AT-B 383 697. The fusible element is thermally coupled to a resistor where the components are located on the same sheet-like substrate. The substrate is made of a ceramic material. The resistor acts as a current sensor. An amount of thermal energy sent from the resistor to the fusible element is equivalent to the amount of current. But within the teaching of this document there is no way of changing the characteristics of the fuse.

According to the invention, the heating element is arranged together with the fusible conductor jointly on the substrate. In this case, the degree of thermal coupling between heating element and fusible conductor is influenced in each case by the distance from each other. The consequently achievable effects of shifting the characteristic curve of the fusible element are explained in more detail below with reference to exemplary embodiments.

Further the distance produced between the heating element and the fusible conductor is kept variable, in order to set the degree of thermal coupling and consequently the tripping characteristic of the fusible conductor and the nominal current while otherwise retaining the same materials and the same geometry of the circuit. With a fixed circuit geometry, setting of the characteristic is possible by simply shifting the individual production masks in relation to one another in a predetermined way and fixed amount.

In a development according to claim 2 the distance between the heating element and the fusible conductor assumes a minimal value when the heating element and the fusible conductor are arranged lying one over the other. This minimal value is in this case determined by the layer thickness of an electrical insulation, which may consist of a dielectric such as glass, but also a ceramic or a curable paste. The good thermal contact may take place over the entire base area of the fusible conductor. Preferably, the fusible conductor is arranged over the heating element, so that there is adequate space available for receiving the gases and particles released in the event of the fusible conductor tripping, as well as for pressure equalization.

According to the invention, the properties of the fusible conductor can be significantly influenced directly by the thermal coupling with the heating element. The thermal coupling is intensified in a simple way by the actual fusible conductor being applied to a thin layer, which preferably consists of silver and effects adhesive bonding with good conduction on the substrate surface. As a result, the characteristic can be reproduced even more exactly.

In the case of a fusible conductor formed as a multilayer arrangement, for example in the case of a material combination of a layer of silver and a covering layer of tin, an additional influencing of the tripping characteristic can be achieved by diffusion processes. Other material combinations with mutual solubility are also possible.

Furthermore, the fusible conductor may have a constriction or tapering in its central region. This reduction in cross-section increases the intrinsic resistance. What is more, the material of the fusible conductor is weakened at this notable point and correspondingly less material has to be melted during tripping. The constriction is advantageously in the "hot spot" of the fuse element.

Alternatively, the fusible conductor may, however, also be a wire, which has, for example, as described above, a silver-tin layering on its surface and/or itself a constriction. To improve the thermal coupling, the wire may be pressed onto or fused onto the substrate.

There are, in principle, several possibilities that are conceivable for the electrical wiring to supply the heating element and the fusible conductor with power, for example a parallel connection. However, it is preferred for the heating element to be electrically connected in series with the fusible conductor on the substrate. Consequently, with the in some cases very small outer dimensions, only two external contacts are required on a fuse element according to the invention.

In a major development of the invention, the heating element itself is also designed as a fusible conductor. This provides a fuse element according to the invention as an electrical connection of two fuse elements, which are in their design primarily assigned the tasks of heating element and fusible conductor by the selection of material and geometry. This type of construction advantageously opens up the possibility of designing the heating element for a different, preferably much higher nominal current $I_N$ than the fusible conductor. By designing the characteristics of the fusible conductor and heating element in the way according to the invention, these curves intersect at a commutation point. From this point, the fusible conductor characteristic of the heating element responds faster than the actual fusible conductor, as will be shown with reference to a diagram. For the following electric circuit, this produces additional protection in the case of extremely high short-circuit currents.

A further advantage is obtained by a covering, preferably of each fusible conductor, by means of a low-melting substance. In the event of tripping of the fuse, the covering prevents molten parts coming into contact with the surroundings. It may be realized in the form of a two-layer structure, a drop of hot-melt adhesive as the core, for example, being covered for its part on the outside and sealed by a thermally stable substance, such as for example a curing embedding compound or a resin. At operating temperature, the core already melts and creates a cavity for receiving gases etc., which is stabilized by the outer shell.

Advantageously, an electrical fuse element according to the invention can be easily adapted in its outer form and dimensions to the requirements of modern insertion methods. A cuboidal form is preferred. The external contacting takes place in adaptation to customary SMD soldering methods by external contacts arranged on two opposite end edges. They are then preferably applied in a galvanic process, if fusible elements with diffusion processes are contained in the fuse element.

Figure 1B:
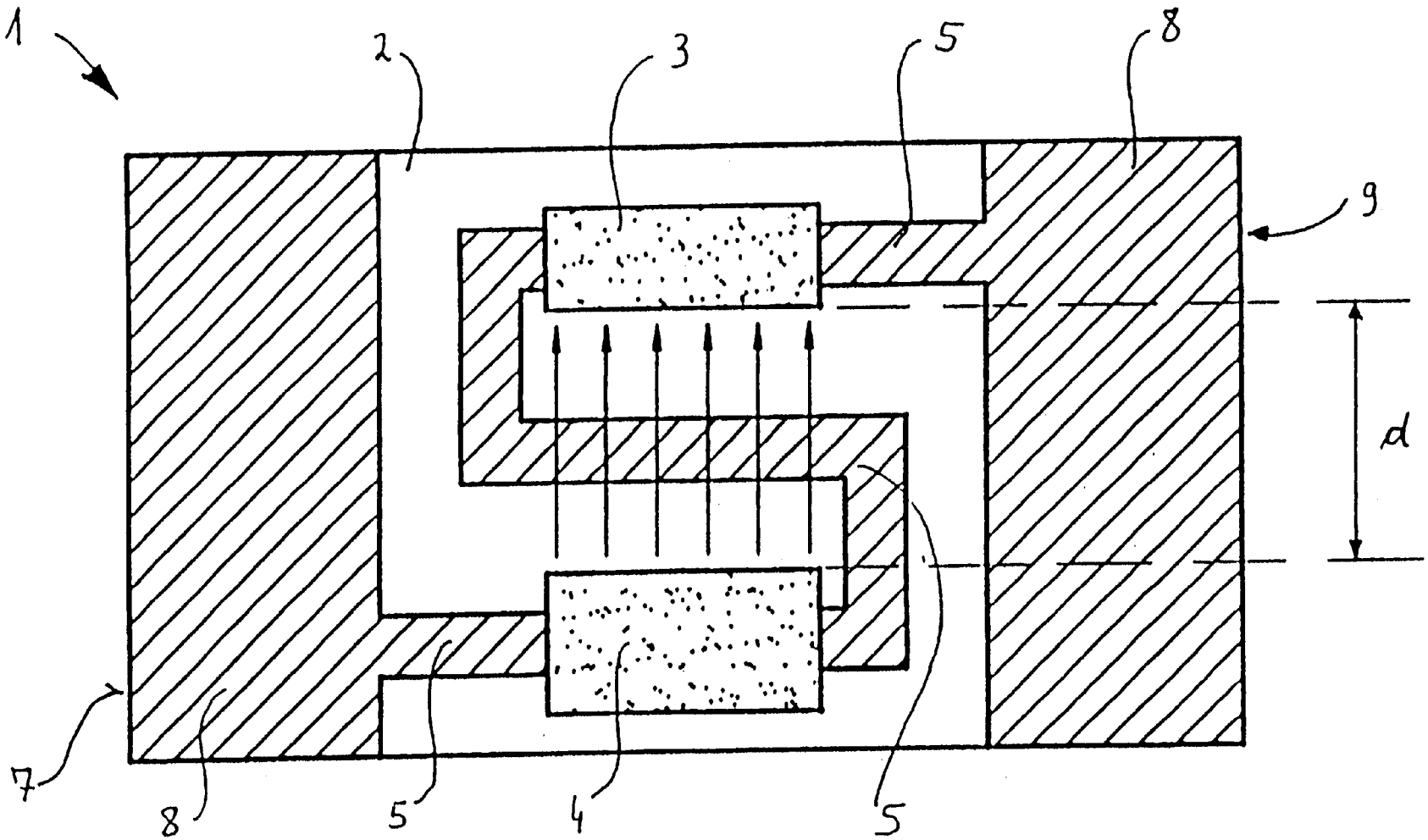

A number of exemplary embodiments of the invention are explained in more detail below with reference to the drawing, in which:

FIG. 1*a* shows a basic representation of a first embodiment of a fuse element in a plan view;

FIG. 1*b* shows a representation of an alternative embodiment of the fuse element from FIG. 1*a;*

Figure 1C:
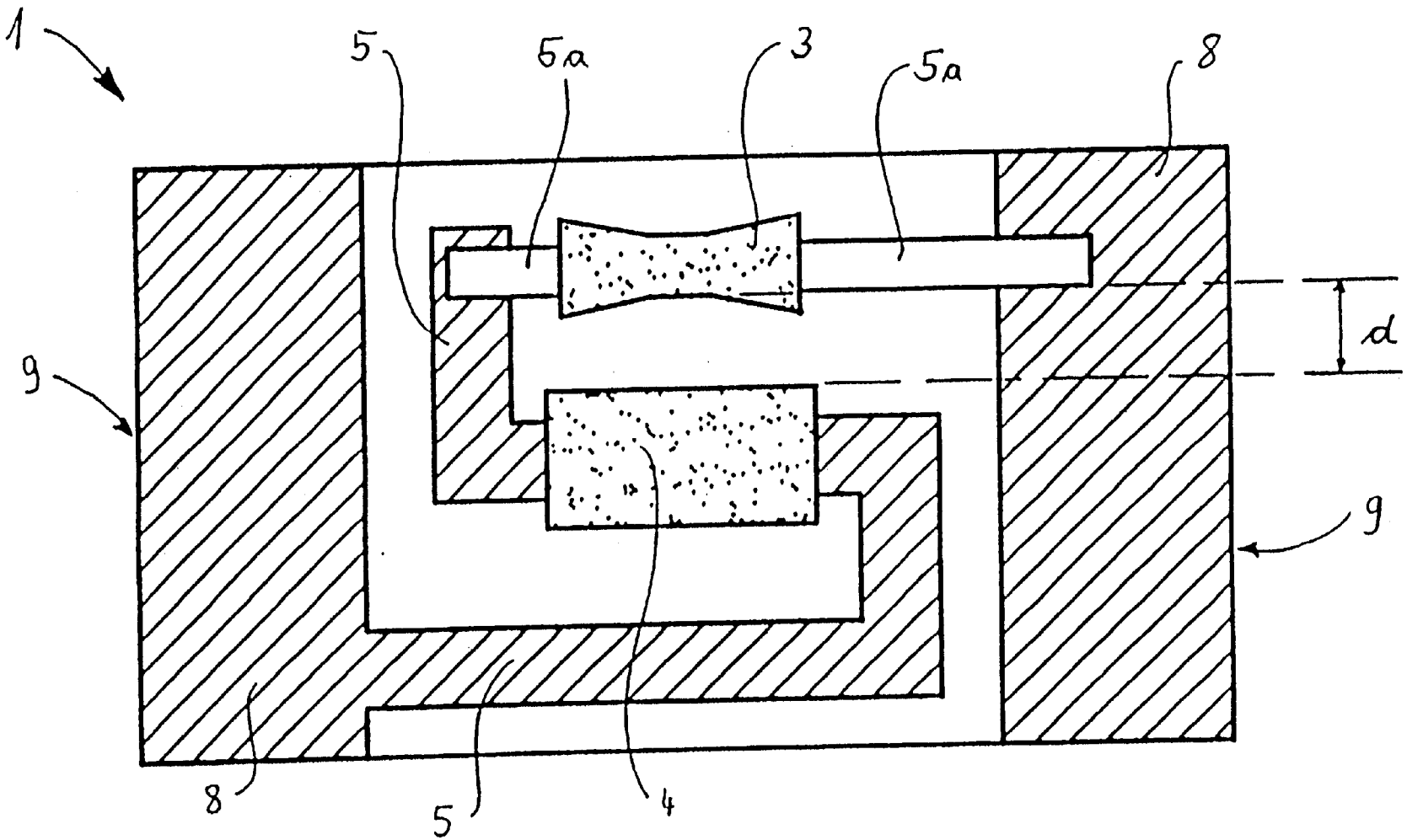

FIG. 1*c* shows a representation of a further alternative embodiment of the fuse element from FIG. 1*a;*

Figure 2:
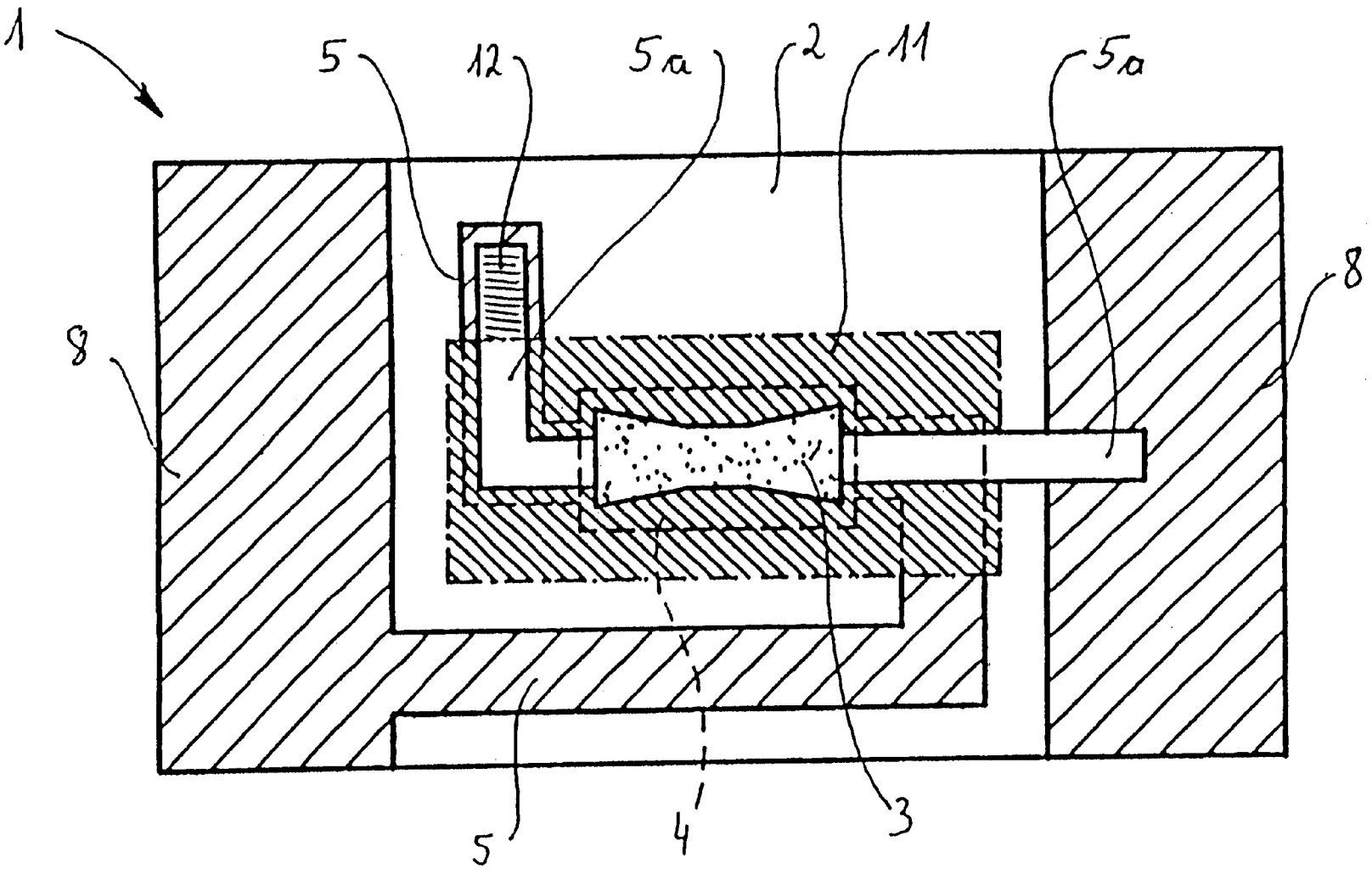
Figure 3:
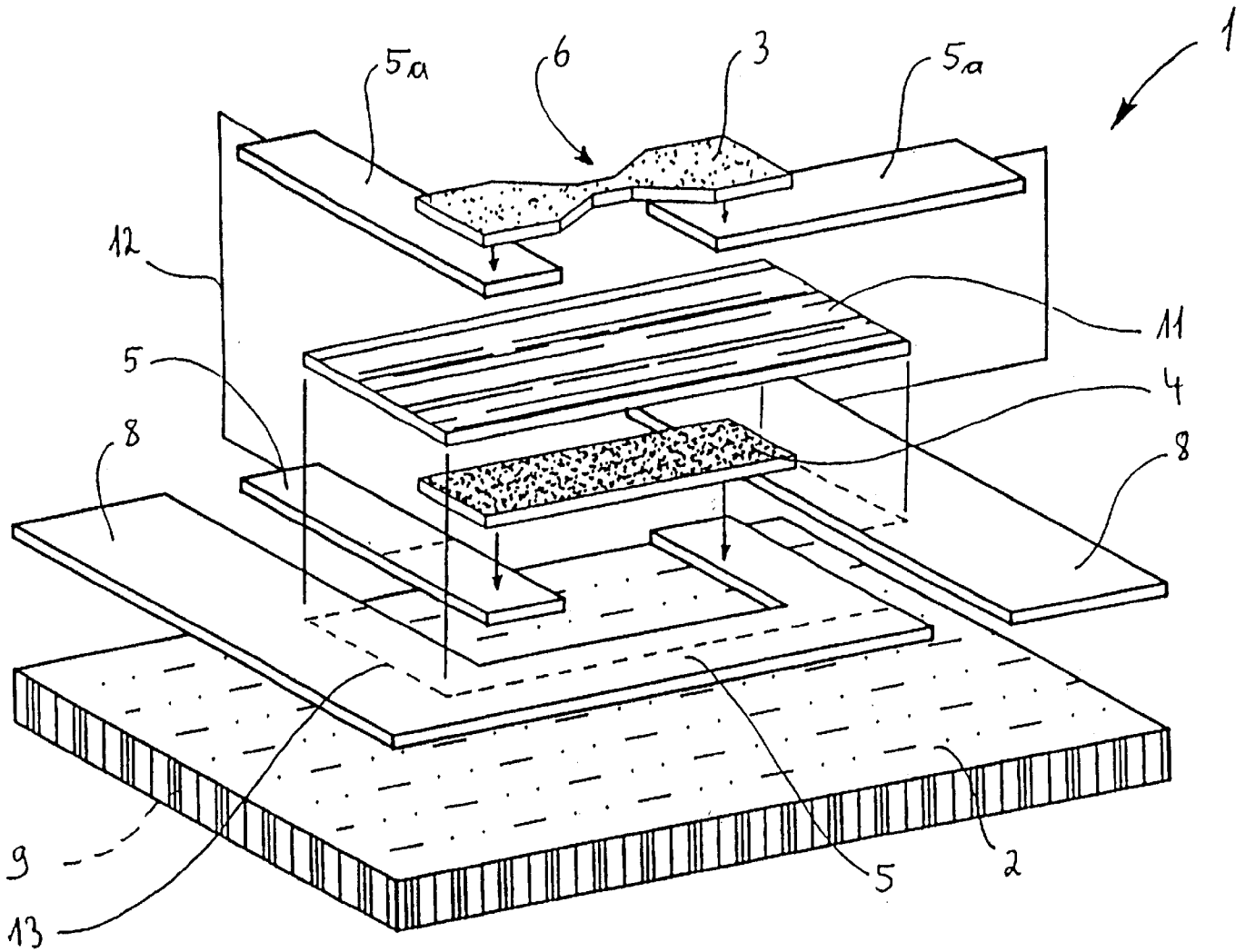
Figure 4:
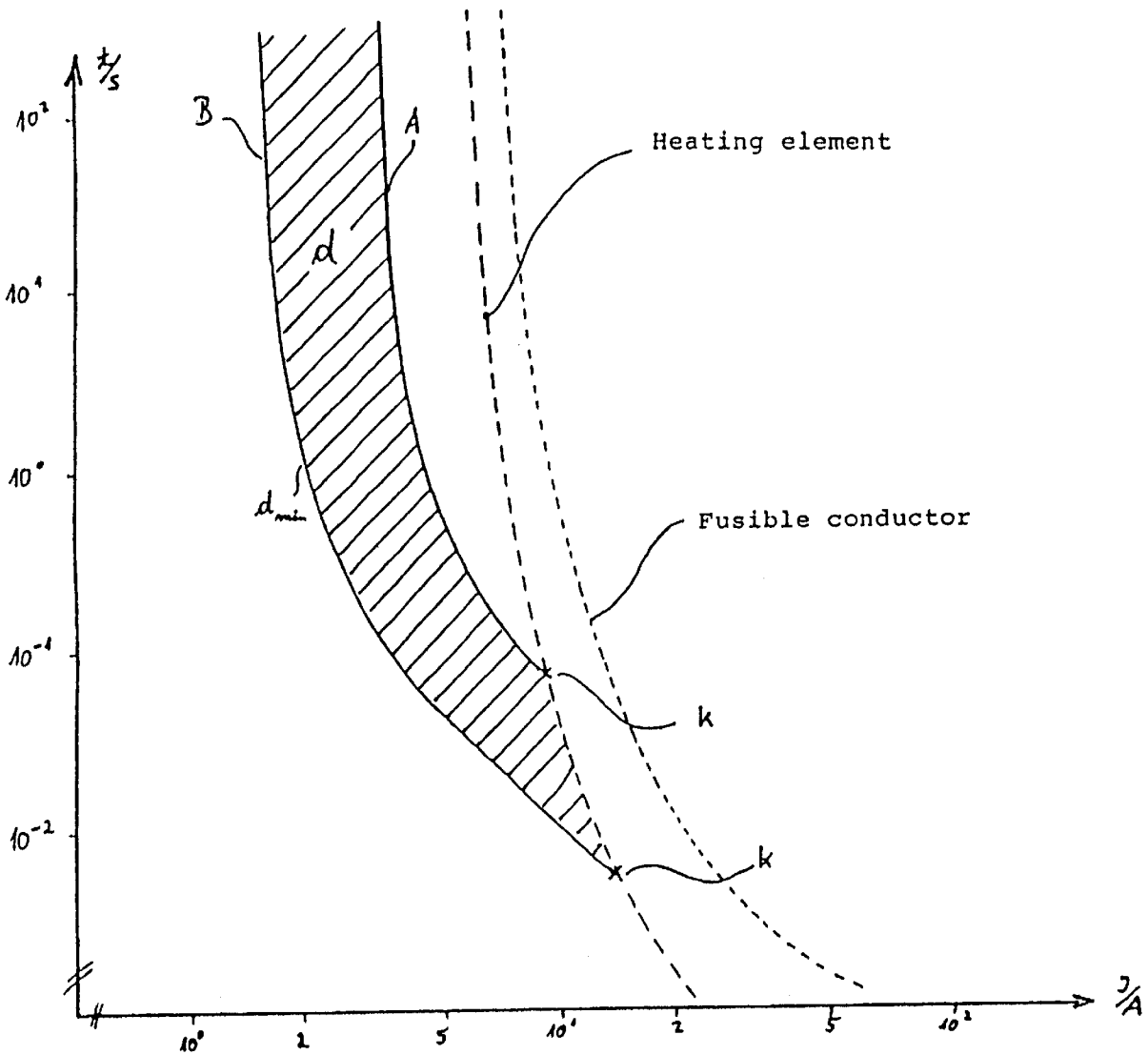

FIG. 2 hows a plan view of a further embodiment of a fuse element with a fusible conductor arranged over the heating element;

FIG. 3 shows a perspective view of a fuse element in an exploded representation and FIG. 4 shows a sketched family of characteristic curves with the switching characteristics achievable in principle of the fuse elements from FIG. 1*c* and FIG. 2.

In FIG. 1*a*, a first embodiment of a fuse element 1 is represented in its basic structure in a plan view. A fusible conductor 3 is arranged together with two heating elements 4 in an S-shaped series connection on a substrate 2 of poor thermal conduction. The individual elements are electrically connected to one another by conducting tracks 5. There is thus obtained here overall a series connection of three elements, which may in each case be designed as a fusible conductor with specific properties. The two heating elements 4 are arranged here symmetrically with respect to the fusible conductor 3 at a distance d, which in both cases is equal. Thus, they heat up the fusible conductor 3 by thermal conduction via the substrate 2 equally in a symmetrically shaped "hot spot".

Among the materials used for substrate 2 of poor thermal conduction is a glass ceramic. Measurements have produced the following, surprising values for the thermal conductivity of such a material in comparison with the $Al_2O_3$ ceramic otherwise preferred in fuse construction:

| Substrate | Static thermal resistance | Thermal impedance |
|---|---|---|
| Glass ceramic | 190 K/W | 6 K/W |
| $Al_2O_3$ ceramic | 26 K/W | 5.4 K/W |

It is evident from the values in this table that an $Al_2O_3$ ceramic dissipates the heat per watt of heating output between the ends of a substrate better by a factor of approximately 7 than the glass ceramic measured here. These values relate to the consideration of the case of steady-state heat removal, which in the case of $Al_2O_3$ ceramic substrates leads to the undesired unsoldering of the external contacts.

If, however, the investigation is restricted to the dynamic thermal conduction behaviour and if, correspondingly, a very small space is considered, also referred to as a segment, only a relatively insignificant difference in heat removal of about 10% is established between $Al_2O_3$ ceramic and the glass ceramic. The thermal coupling between fusible conductor and heating element is thus almost as good with the use of a glass ceramic substrate as in the case of an $Al_2O_3$ ceramic substrate. Accordingly, significant differences occur only in the consideration of the thermal conduction at the ends of common substrate sizes, where an $A1_2O_3$ ceramic effects an undesired heating of the external contacts on account of its much better thermal conduction.

The degree of thermal coupling between the heating element and the fusible conductor can be set over a wide range by the distance d. The influence of the thermal coupling on the switching characteristics of the fuse element is shown and described later with reference to a family of characteristic curves.

Arranged adjacent to two opposite end edges 7 of the substrate 2 are conducting faces 8. To complete the production process, the end edges 7 are metallized, so that they form the external contacts 9, which are electrically connected to the faces 8. Use of the substrate 2 of poor thermal conduction has the effect that there is little heating up of the external contacts 9. There is consequently also a reduction in the power loss of the fuse element required as heating power, so that this fuse element 1 has little influence on the remaining electric circuit.

The fuse element 1 from FIG. 1*a* has been realized in its essential parts by a screen-printing process. In the case of very small structure sizes, a photolithographic process is more suitable. In the present case, the fusible conductor 3 is produced as a thick film, which has a tapering 6 in its central region. The tapering 6 is a further measure for influencing the tripping characteristic. Depending on the desired characteristic, it may also be omitted. As a further production possibility, the fusible conductor 3 may also be used in the production process in the form of a piece of wire. In the present case, the fusible conductor 3 is applied to the substrate 2 as a thin layer of silver, onto which subsequently a layer of tin is applied as the actual, low-impedance conductor.

The central region of the fuse element 1, in which the heating elements 4 and, in particular, the fusible conductor 3 are located, is provided with a covering 10. The covering 10 is indicated in FIG. 1*a* as a dashed line and protects the sensitive part of the circuit on the substrate 2 from external influences. Furthermore, gases or metal particles emitted during tripping of the fuse element 1 are kept away from the surrounding electric circuit.

FIG. 1*b* represents an alternative form of the fuse element 1 from FIG. 1*a*, which contains only a heating element 4 and a fusible conductor 3 without constriction 6. The thermal coupling entered in the form of arrows, is less than in the arrangement from FIG. 1*a* on account of the appreciably increased distance d between heating element 4 and fusible conductor 3. The basic representation of FIG. 1*b* is primarily intended to demonstrate the freedom of design, with several possibilities for the arrangement, although no change has been made to the basic geometry of the circuit, comprising conductive faces 8, external contacts 9 and conductive tracks 5.

FIG. 1*c* represents a further developed form of the fuse element 1 from FIGS. 1*a* and 1*b*, in which the heating element 4 and the fusible conductor 3 are again moved closer together, reducing the distance d, to increase the thermal coupling. It is intended by the different type of representation in FIG. 1*c* to point out that the regions of the faces 8 and conductive tracks 5 of good electrical conductance can also be produced in two or more mask steps. Setting the thermal coupling by variation of the distance d is advisable, however, when using two masks for building up the conductive tracks 5 and 5*a*, since in this way the distance d can easily be changed by shifting the masks in relation to each other, without the production of a new mask being required.

FIG. 2 represents a plan view of an alternative embodiment of a fuse element 1, the fusible conductor 3 here being arranged over the heating element 4 on the substrate 2. Arranged between the fusible conductor 3 and the heating element 4 is an electrical insulation 11, which is formed here by way of example by a thin layer of glass. The thermal coupling in the embodiment represented takes place over the entire surface area of the fusible conductor 3 and therefore, and because of the minimal distance $d_{min}$, increases to a maximum value.

Depending on the selection of materials, the circuit from FIG. 2 may also be produced in two process steps, which are in each case completed by a sintering operation. In a first step, the conducting faces 8, the conductive tracks 5, the heating element 4 and the insulation 11 over the heating element are applied in one mask. In a subsequent production step, the second level is applied, which essentially contains the fusible conductor 3 and two conductive tracks 5, which electrically connect a conducting face 8 to the fusible conductor and establish a conducting connection with the lower level of the circuit via a contacting assembly 12.

Subsequently, the circuit may be covered, at least in the region of the fusible conductor 3, by a curing embedding compound. This covering is applied in two steps, with a low-melting substance being applied first of all. This is, for example, a hot-melt adhesive, which covers only the fusible conductor. It is covered by a thermally stable substance. During the operation of the fuse element, the melting drop of adhesive creates directly above the fusible conductor, in the "hot spot", a stable cavity for receiving plasma during the tripping of the fuse element 1.

The direct comparison of FIGS. 1*c* and 2 shows that, in principle, the same masks are used here for producing fuse elements with very different switching characteristics and/or nominal currents $I_N$. Introducing the insulation only necessitates one further mask step in the production sequence according to FIG. 2. The mask of the upper conductive track 5*a* requires a small modification. Essentially, however, these structures are the same as one another. Consequently, only one set of masks is required for producing a wide variety of SMD-insertable fuse elements and a standard, adapted range of pastes or the like can be used in cost-effective mass processes.

FIG. 3 perspectively shows in an explosive representation a design for a fuse element 1 with all the individual elements listed above. The solid lines and arrows in this case represent conducting connections. The line 13 shows the outline of the bearing face for the insulation 11. The elements represented in planes may be produced here as layers, in each case by a process mask. The arrangement of the elements with respect to one another and the forming of the conductive tracks 5 opens up the possibility here that the fusible conductor 3 and the heating element 4 can be varied in relation to each other by shifting the process masks in terms of the distance d between them. The variation in distance is not shown in this illustration. However, the arrangement represented in FIG. 3 can be used correspondingly to realize, as limiting cases, either fuse elements according to FIG. 2 or fuse elements according to FIG. 1*c*. In this case, the fuse element 1 according to FIG. 2 contains only one heating element 4, so that, although the thermal coupling can be set here by variation of the distance d, the "hot spot" is not fully symmetrically formed in the region of the fusible conductor 3. However, this influence can be minimized by appropriate design of the circuit. As soon as the distance between the tapering 6 of the fusible conductor 3 and the heating element 4 is large enough that there is no overlap between fusible conductor 3 and heating element 4 and an adequate insulation between the conductors is obtained, the insulation 11 may be omitted, thus dispensing with one substep in the process.

FIG. 4 represents a sketched general family of characteristic curves to represent switching characteristics of different fuses. The curves are plotted with a logarithmic scale on both axes. It can be seen that, in the present case, the heating element alone is designed for a lower nominal current $I_N$ than the fusible conductor. The fusible conductor is, for example, built up as a multilayer conductor by using a silver-tin diffusion and accordingly has only a quick-acting switching characteristic, while the heating element alone trips with a very quick action. With this design of the individual elements, the series connection with thermal coupling allows an increase in the inertia in the overall fuse element to be achieved. In the converse case, a greater tripping capacity can be produced.

The characteristic of the individual elements in any event differs distinctly from that of the overall circuit. It shows here a distinctly slow-acting characteristic, which until now could not be realized by components of small dimensions. The influence of the thermal coupling between the heating element and the fusible conductor can be seen in the shift to the left, into the range of lower nominal currents $I_N$, of the curve for the switching characteristic of the fusible conductor. The curve in itself changes its shape only insignificantly. By variation of the distance d, the shifting of the fusible conductor characteristic can be influenced. With a minimal distance $d_{min}$, the nominal current $I_N$ assumes a minimal value if the material and the geometry of the fusible conductor remain the same, see curve B. Consequently, by a construction according to FIG. 3, the wide range between the curves A and B represented in FIG. 4 can be freely set during production by variation of the distance d. Consequently, with the geometry and material selection remaining the same, a large range of nominal currents can be covered with the same tripping characteristic.

In the lower third, the shifted curves intersect with the characteristic of the heating element at a so-called commutation point K. This point is in practice to correspond to a current of slightly more than $10 \times I_N$. For higher currents, the curve of the heating element then determines the tripping characteristic of the respective fuse element, no longer the characteristic of the indirectly heated fusible conductor. Thus, faster tripping times are realized for higher short-circuit currents.

In tests, fuse elements were constructed with substrate dimensions of 6.5×25 mm and 46×3.2 mm. These are common dimensions in SMD technology. At ten times the nominal current $I_N$, switching times of 10–15 ms were measured for nominal currents of about 0.4 A. Consequently, efficient fuse elements with slow-acting tripping characteristics were realized for the first time in the size of SMD components. With a fuse element corresponding to FIG. 1*c*, the heating resistance was 0.6 Ω. The fusible conductor resistance was in this case 0.03 Ω. Thus, for the series connection, altogether only a resistance of about 0.63 Ω is obtained.

In the case of the variant according to FIG. 2, a heating resistance of 0.1 Ω and a fusible conductor resistance of 0.03 Ω were realized for a nominal current $I_N$ of about 0.315 A, a layer of glass of the thickness $d_{min}$ of about 20 μm being used as the dielectric. Both circuit variants were produced by thick-film technology on a glass ceramic substrate, using paste materials common in hybrid technology. In thick-film technology production processes, currently line widths of up to 0.1 mm can be reliably produced in the case of layer thicknesses of between 6 and 20 μm.

It can be seen from these actually realized exemplary embodiments that, in the case of the variant according to FIG. 2, the heating resistance of the heating element 4 may turn out to be relatively low on account of the much improved thermal coupling.

What is claimed is:

1. A surface mounted electrical fuse element, comprising a sheet-like substrate including a glass ceramic, the substrate having a top and a bottom surface;

at least one fusible conductor;

a resistive element acting as a heating element, said at least one fusible conductor and said resistive element being arranged on the top surface of the substrate and in thermal contact with each other, and said at least one fusible conductor and said resistive element forming a series circuit; and wherein when a current flows through the series circuit formed by the at least one fusible conductor and the resistive element, the resistive element heats the at least one fusible conductor such that the fuse element exhibits a slow-acting tripping characteristic.

2. Electrical fuse element according to claim 1, wherein the resistive element is also designed as a fusible conductor.

3. Electrical fuse element according to claim 2, wherein the resistive element is designed for a defferent nominal current than the at least one fusible conductor.

4. Electrical fuse element according to claim 1, wherein a distance between the resistive element and the at least one fusible conductor assumes a minimal value when the resistive element and the at least one fusible conductor are arranged lying one over the other separated by an insulating layer or insulation.

5. Electrical fuse element according to claim 1, wherein the at least one fusible conductor is formed as a multilayer arrangement.

6. Electrical fuse element according to claim 1, wherein the at least one fusible conductor has a constriction.

7. Electrical fuse element according to claim 1, wherein the at least one fusible conductor is a wire.

8. Electrical fuse element according to claim 1, further comprising a cover above each fusible conductor, said cover includes a low-melting substance covered by a thermally stable substance.

9. Electrical fuse element according to claim 2, wherein the at least one fusible conductor is formed as a multilayer arrangement.

10. Electrical fuse element according to claim 2, wherein the at least one fusible conductor has a constriction.

11. Electrical fuse element according to claim 2, wherein each fusible conductor is covered by a low-melting substance, and the low-melting substance is covered by a thermally stable substance.

12. Electrical fuse element according to claim 1 wherein the resistive element is designed for a higher nominal current than the at least fusible conductor.

13. Electrical fuse element according to claim 9 wherein said multilayer arrangement includes a layer of silver and a covering layer of tin.

14. Electrical fuse element according to claim 11 wherein said low-melting substance is a hot-melt adhesive.

15. Electrical fuse element according to claim 11 wherein said thermally stable substance includes a curing embedding compound or a resin.

16. Electrical fuse element according to claim 5 wherein said multilayer arrangement includes a layer of silver and a covering layer of tin.

17. Electrical fuse element according to claim 8 wherein said low-melting substance is a hot-melt adhesive.

18. Electrical fuse element according to claim 8 wherein said thermally stable substance includes a curing embedding compound or a resin.

19. Electrical fuse element according to claim 1 wherein said substrate consists of glass ceramics.

20. A surface mounted electrical fuse element, comprising a sheet-like substrate consisting of a material having a static thermal resistance that is approximately seven times greater than that of $Al_2O_3$ for a thermal impedance, the substrate having a top and a bottom surface;

at least one fusible conductor;

a resistive element acting as a heating element, said at least one fusible conductor and said resistive element being arranged on the top surface of the substrate and in thermal contact with each other, and said at least one fusible conductor and said resistive element forming a series circuit; and wherein when a current flows through the series circuit formed by the at least one fusible conductor and the resistive element, the resistive element heats the at least one fusible conductor such that the whole fuse element exhibits a slow-acting tripping characteristic.

* * * * *